United States Patent [19]

Riggs

[11] 4,282,868

[45] Aug. 11, 1981

[54] BODY TRACTION DEVICE

[76] Inventor: Dean D. Riggs, 147 Burton St., Avon Lake, Ohio 44012

[21] Appl. No.: 121,905

[22] Filed: Feb. 15, 1980

[51] Int. Cl.[3] ..... A61H 1/02

[52] U.S. Cl. ..... 128/75; 128/71; 272/116

[58] Field of Search ..... 128/75, 69, 70, 71, 128/84 R, 84 B, 84 C; 272/116, 144, 145, 134, 93, 120

[56] References Cited

U.S. PATENT DOCUMENTS

| | | | |
|---|---|---|---|
| 933,170 | 9/1909 | Galbreath | 128/70 |
| 1,070,467 | 8/1913 | Heggen | 128/75 |
| 2,815,022 | 12/1957 | Krumm | 128/75 |
| 3,105,489 | 10/1953 | Zivi | 128/75 |
| 3,413,971 | 12/1968 | Evans | 128/75 |
| 3,547,111 | 12/1970 | Viel | 128/75 |
| 3,750,658 | 8/1973 | Dawson, Jr. et al. | 128/75 |
| 3,986,499 | 10/1976 | Fischer | 128/71 |
| 4,102,336 | 7/1978 | Wiener et al. | 128/75 |
| 4,114,611 | 9/1978 | Lyle et al. | 128/75 |

FOREIGN PATENT DOCUMENTS

| | | | |
|---|---|---|---|
| 896008 | 3/1972 | Canada | 128/69 |
| 394484 | 3/1962 | Switzerland | 128/71 |
| 1191058 | 5/1970 | United Kingdom | 128/75 |

*Primary Examiner*—Robert W. Michell
*Assistant Examiner*—Arthur S. Rose
*Attorney, Agent, or Firm*—Robert A. Sturges

[57] ABSTRACT

There is provided an improved patient operated traction apparatus characterized by an articulated frame having a head portion which is pivotally mounted relative to the elongated side rails of a foot portion. The side members of the head portion are pivoted intermediate their ends, thereby providing a projection extending beyond the pivot point and useful as a lever arm for actuating the head portion relative to the foot portion whereby the respective distal extremities are moved in a direction away from each other for applying tension to the patient. Suitable straps are provided at the opposite ends of the apparatus for attachment to the body of the patient.

11 Claims, 2 Drawing Figures

BODY TRACTION DEVICE

This invention relates to a body traction device, and more particularly to a device which is adapted for use by a patient outside of a hospital. The devices of the present invention are characterized in that they may be secured by the patient to himself, and traction applied by the patient to the extent necessary.

BACKGROUND OF THE INVENTION AND PRIOR ART

The use of traction in the treatment of injury involving the spine, for example, neck injuries as may occur from "whip lash", or injuries to joints such as the knee, the hip, the elbow or the shoulder, is well known. Ambulatory patients who require periodic treatment to relieve pain or promote healing have, in many cases been required to enter a hospital on an in-patient or out-patient basis to receive such treatment. A substantial portion of these cases could be treated in the patient's home if a suitable, portable, simple traction device were available. Suitability of such a device requires that it be attachable by the patient to the extremities of a body portion requiring treatment, and operable by the patient to impose the necessary tensile forces. Portability of the device requires that it be easily disassembled and packaged so that the patient is not limited in his mobility to a given location where treatment may be obtained at a prescribed time. Simplicity of the device requires that the device be relatively inexpensive and free of complicated apparatus, such as complicated extension means, load measuring devices, etc.

The improved structure of the present invention is not the first traction device to be usable at home, for example, or the first to be patient operated.

An early example of a traction device is shown in U.S. Pat. No. 1,070,467 composed of a rigid pipe frame of generally fixed rectangular configuration having strap means at one end for engaging the upper portion of the torso, and a movable cross head at the other end having flexible strap means for engaging the legs or ankles of the patient. The cross head is moved by means of a crank and screw, the crank being bearinged on one end of the frame and having a screw member extending into the cross head to enable movement thereof in any direction. It cannot be operated by the patient.

Another traction device is shown in U.S. Pat. No. 2,815,022 and consists of a single elongated member spanning a patient's body, having a yoke fixedly secured to one end and carrying a strap for holding the patient's head, and a foot end adapted to hold flexible straps for engaging the ankles of the patient. Tension is applied by means of a rack and pinion apparatus coacting with a lock to maintain a given setting.

A patient operated device is provided in U.S. Pat. No. 3,105,489 and depends upon a patient applied load to apply tensileforce. The head of the patient is held in a flexible strap when the patient is seated in a chair. The free ends of the strap are supported on a line having an intermediate weighing scale, with the distal end of the line being secured to a lever operated apparatus attached to the upper part of a wall or door, for example, and a depending handle portion which can be grasped by the patient to regulate the amount of tension as indicated by the scale.

Another device for applying traction to the body is shown in U.S. Pat. No. 3,413,971. Here a generally rectangular frame is provided having cross members at either end adapted to retain flexible body holding straps or apparatus. The cross members are maintained in spaced relation by means of adjustable and extensible side rails. Pin hole settings are provided for rough adjustment, and threaded members provided for applying the desired amount of tension.

A more recent U.S. Pat. No. 3,750,658 contemplates a cervical spine traction apparatus which is designed to be used with a door and the upper frame of the door to provide an anchor point for a harness. The harness is provided with a pair of vertically extending load straps adapted to hold the head of a patient. The harness is secured to webbing members which extend between the upper edge of the door and its mating door frame while the door is closed, and held laterally spaced by a cross bar secured to the loading straps. The webbing members are releasably secured to the cross bar which is adapted to bear against the opposite upper face of the door from that of the harness to anchor the apparatus to the top of the door.

U.S. Pat. No. 4,102,336 shows an apparatus for the application of traction to various parts of the body comprising a rigid frame with two parallel side rails interconnected by at least one cross bar to which a body engaging strap is connected. Each side rail carries an adjustably mounted self-locking hand grip which is grasped by the user laying on a supporting surface over which the frame is freely slidable. The user pulls or pushes the hand grips while having his hip, neck or feet strapped to the frame. The hand grips when unlocked are swingable in planes traverse to the side rails and may also be slidable thereon by the user until such movement applies the traction-generating force.

A more recent reference is U.S. Pat. No. 4,114,611 which discloses a portable traction device suitable for hospital, office or home use. This device comprises of frame adapted to fit about the patient while laying down. The frame is provided with two telescoping side members and two end members. The end members have connecting means which are adapted to be coupled to the patient's body at two different points. Springs are provided for biasing the telescoping members outward to apply traction to the patient's body.

The present device differs from the prior art structures in that it is characterized by two portions which are pivotally secured together, one of the portions being generally U-shaped and adapted to be attached to one portion of the body, such as the feet, and the other portion which is adapted to be attached to an opposite portion of the body being pivotably secured to the outer ends of the side members defining the U-shaped portion. The attachment of the head member or outer member is pivotable, and desirably adjustable. Because of the location of the pivot point, lever means are provided which may be actuated by the patient to impose a desired traction force to the patient's body or portion thereof undergoing treatment. In a convenient embodiment, the head portion is rectangular and pivotally secured by pivot means extending through the side rails of the rectangular portion at a point intermediate the ends of the side rails. The proximal ends of the side rails are joined together by a cross member which provides a convenient hand hold for operation by the patient to exert the desired amount of force. The opposite cross member is provided with means for attaching a flexible harness or strap for engaging the patient's head, for example. Movement of the cross bar of the head member at the proximal end of the side members toward the body of the patient tends to move the cross bar at the distal extremity of the head portion away from the cross bar at the bottom of the U-shaped portion thereby exerting tension forces on the body of the patient.

In a preferred embodiment, the device of the present invention can be completely disassembled and packed into a relatively small carrying case for transport with the patient to whatever location he desires.

BRIEF STATEMENT OF THE INVENTION

Briefly stated, therefore, the present invention is in a patient operated traction apparatus for the application of tension to the body of the patient. The apparatus comprises an elongated articulated frame which includes a longitudinally extending member, a head end comprising a member pivotally secured at a point intermediate its end to the longitudinally extending member to define a freely extending lever arm which lever arm is accessible to the patient to enable him to apply tension. The head end is also adapted to carry flexible strap means at its distal end for attachment to the body of a patient.

A foot end is provided which is fixedly attached to the opposite end of the longitudinally extending member. The foot end is also adapted to carry a flexible strap for attachment to the body of the patient. In use, the patient forms the third side of a generally triangular configuration with the pivot point of the articulation of the frame above the portion of the patient's body which is to be placed under tension. Application of a downward force by the patient on the proximal cross-bar of the head member tends to move the foot end and distal end of the head end apart and thus apply tension between the points of connection of the flexible straps to the body of the patient.

BRIEF DESCRIPTION OF THE DRAWINGS

The foregoing invention may be better understood by having reference to the annexed drawings illustrating a preferred embodiment of the present invention, and wherein.

DETAILED DESCRIPTION OF THE DRAWINGS

Figure 1:
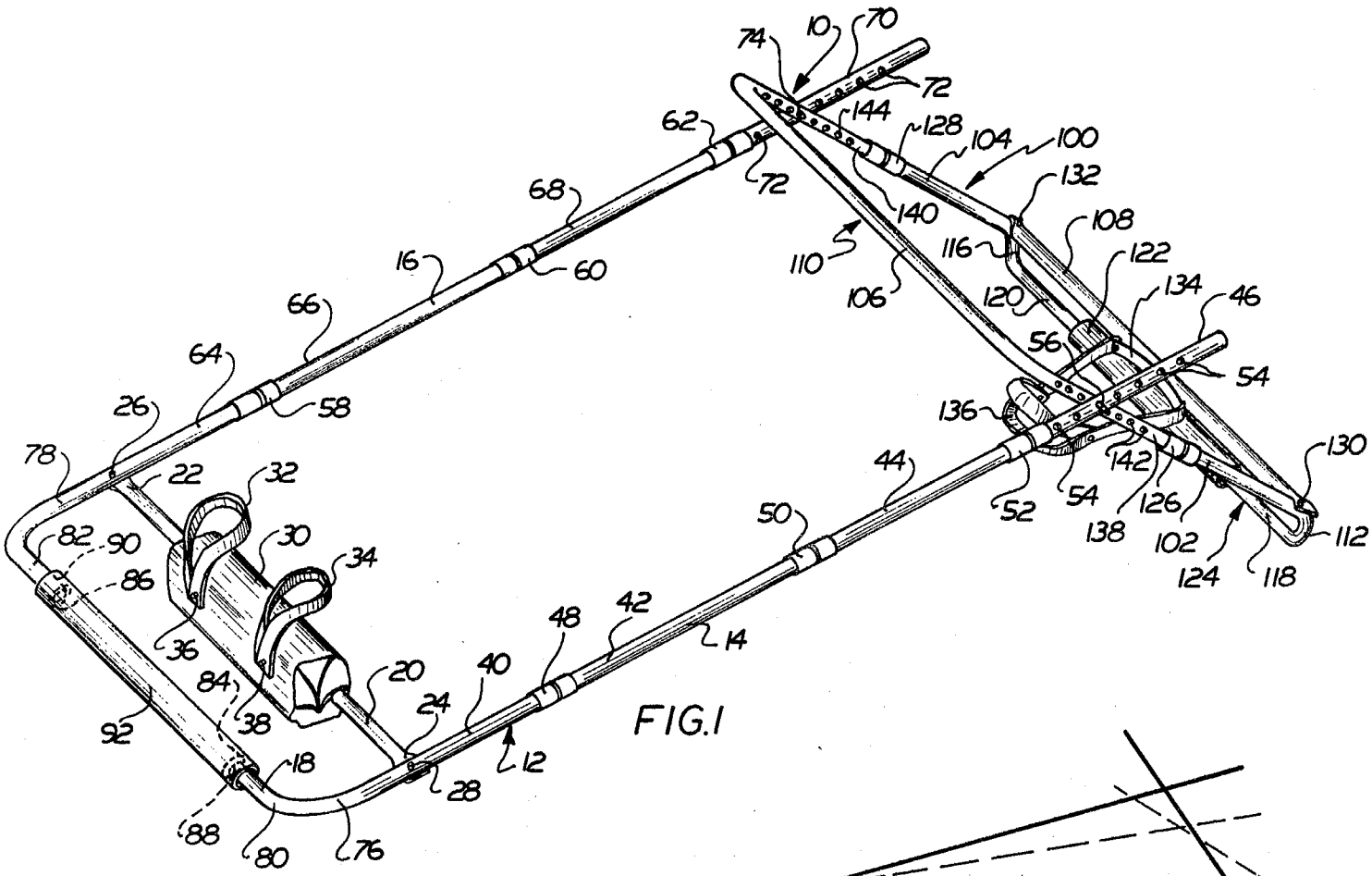
FIG. 1 is a perspective illustration of one form of patient operated traction apparatus in accordance with the present invention.

Referring now more particularly to FIG. 1, there is here shown a view in perspective of a patient operated traction apparatus in accordance with the present invention. It should be assumed that the device is resting on a flat surface such as a floor or floor covering. Generally, the apparatus is an articulated frame 10 having a generally U-shaped portion 12 composed of a pair of parallel side members 14 and 16 joined together at the distal extremity thereof by a cross bar 18. Spanning the distal end of the U-shaped member 12 adjacent the extremity and spaced therefrom, there is provided a second cross bar 20 which is parallel to the cross bar 18. The ends 22 and 24 are conveniently flattened and shaped for securement to the tubular sides 14 and 16 by any suitable means such as a rivet or threaded fastener 26 and 28.

The cross member 20 is located at the foot end of the apparatus and conveniently carries a padded member 30 encircling the cross bar 20 and to which are suitably affixed flexible straps 32 and 34 as by means of rivets 34 and 38. The flexible straps 32 and 34 are adapted to engage and hold the ankles of the patient.

The side arms 14 and 16 are, as indicated above, formed of a tubular material, such as steel, and for ease in disassembly and packaging into a small container, each of the side arms 14 and 16 is desirably segmented into smaller pieces. Thus, the side arm 14 is segmented into the parts 40, 42, 44, and 46. The confronting ends of the parts 40 and 42, for example, are joined together by any suitable coupling means such as the coupler 48. The coupler 48 may be internally threaded to accept externally threaded ends of the tube portions 40 and 42, for example. Any suitable coupling means which will hold the members 40 and 42 together when under tension may be used. Such coupling devices are well known in the art and need not be further detailed in the present invention. In like manner, a coupler 50 is provided for coaction between the parts 42 and 44, a coupler 52 is provided for coaction between the parts 44 and 46.

The part 46 is at the proximal end of the U-shaped frame member. To provide for adjustability of the apparatus to accommodate persons of different size, for example, as well as to accommodate portions of the body of different length, the segment 46 is provided with a plurality of longitudinally spaced openings 54 which are dimensioned for coaction with a pivot pin 56. The pivot pin 56 may be a headed member including a non-threaded central shank portion for engagement with the tubular members, and threaded or pierced at the termination of the shank portion for securing in place by a suitable nut or cotter. Any suitable pin and pin retention means may be used. Such devices are well known to those skilled in the art and need not be further described herein.

The opposing side member 16 is similarly configured to the side member 14. Thus, couplers 58, 60 and 62 coact between arm segments 64–66, 66–68, and 68–70. The proximal extremity of segment 70 is provided also with pin receiving openings 72 for receipt of a pivot pin 74 in the same manner as described above for the opposite side of the frame. Pivot pins 56 and 74 are advantageously coaxially disposed in opposed holes 54, and 72, respectively. The distal extremity of the frame portion 12 is conveniently provided with L-shaped members 76 and 78 having inwardly extending portions 80 and 82, respectively. The inner extremities 84 and 86 of the L-shaped members 76 and 78 are carried in suitable bushings 88 and 90 on which is mounted a roller 92. The bushings and roller may be made of a suitable low friction material such as nylon to enable the roller 92 to rotate easily. Any suitable mounting means for the roller 92 may be employed.

The opposite end of the articulated frame included a head member 100 of generally rectangular configuration. The head member 100 is composed, therefore, of tubular side members 102 and 104. These members are parallel and opposing each other. Also provided to complete the rectangular configuration are a proximal cross member 106 and a distal cross member 108 in parallel opposed relation. The side members 102 and 104 are conveniently segmented, and in combination with the cross member 106, for example, provides a U-shaped member 110. In the embodiment shown in FIG. 1., the side members 102 and 104 are each bent less than 90° out of the direction of the axis thereof at 112 and 116, respectively, and terminate in inwardly projecting portions 118 and 120. The portions 118 and 120 may be continuous, i.e., a single bar, or they may be relatively short extensions for attachment to a roller 122 in a manner similar to that disclosed for the roller 92. Any suitable means for attaching the roller 122 may be provided.

The portion 124 of the head member 100, therefore, is also generally U-shaped except for the slight displacment explained above, and the confronting ends of the U-shaped portions 124 and 110 are joined together by means of couplers 126 and 128. The couplers 126 and 128 may be of the same kind as used for joining the other segments, such as segments 64 and 66 of the side rail 16. Again, any suitable tube coupling means may be employed.

To provide a support for a second flexible strap means, there is provided a cross member 108 which is suitably flattened at each end and secured to the U-shaped member 124 by any suitable fastening means such as bolts 130 and 132. In a centrally located position, there is provided a strap holding support 134 to which is attached a flexible strap 136 by any suitable means. In the embodiment shown in FIG. 1., the flexible strap 136 is adapted to engage the head of the patient.

In use, the device is conveniently assembled from the parts described above, for use on the floor, a pad, or a bed, and the patient disposes himself in a reclining position between the side rails 14 and 16. The straps 32 and 34 are conveniently affixed to the ankles of the patient by himself if necessary, and the patient also by himself may secure the head strap. If the device is of improper length, adjustment may be made by using the openings 54 in the side rail 14 and 72 in the side rail 16 to relocate the pivot pins 56 and 74 for proper lengthening or shortening of the device. To adjust the degree of leverage, the U-shaped portion 106 in the side legs 138 and 140 is conveniently provided with corresponding axially spaced holes 142 and 144, respectively. By means of these openings, the lever arm length can be increased or decreased selectively.

Figure 2:
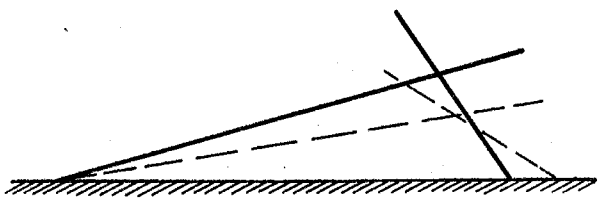
FIG. 2 is a stick diagram showing the effect of pivotal action of the head member relative to the side portion of the frame and the relative movement of the extremities thereof away from each other as shown in the dotted lines.

When the patient is fully strapped in and reclining, he grasps the cross bar of the unit 106 on the head member 110 and draws this bar downwardly. In the manner shown in FIG. 2., this operation causes the distal and proximal ends carrying the rollers 92 and 122, respectively, to tend to move apart, thereby causing a corresponding movement of the strap bearing portions 108 and 20 resulting in the application of a tensile force to the body portion of the patient. In this illustrative case, the spine is being treated.

It will be clear to those skilled in the art that numerous variations are available. The nature of the flexible straps 32, 34 and 136 may be changed. For example, a waist engaging harness may be provided such as that shown in U.S. Pat. No. 4,114,611. Other harness arrangements may be provided for applying traction to a leg, for example, to relieve injury to a knee joint. Scale means to indicate the load may be inserted between the head straps and the anchor therefor, if desired.

It should be noted that although individual pivot pins 56 and 74 have been shown in the embodiment illustrated in FIG. 1., it will be understood that a continuous pivot bar may be substituted therefor without anyway altering the manner in which the apparatus operates.

For the purposes of this description and in the claims, the proximal end of the parts of the apparatus is adjacent the pivot points 56 and 74. The distal ends are at the points remote from the pivot points. The apparatus is considered to be "articulated" in that as assembled, the head portion 110 may be rotated about the pivot pins 56 and 74 out of the plane of the balance of the apparatus in either direction.

It will be understood that the flexible strap means 32, 34 and 136 are shown for illustrative purposes only, and any suitable means for connecting the apparatus to the body of the patient may be used without departing from the scope of the invention.

What is claimed is:

1. A patient operated traction apparatus for the application of tension to the body of a patient comprising a generally U-shaped frame member having a distal foot portion extending between longitudinally extending side members each terminating in a proximal end and defining said U-shape, and a generally rectangular head member having opposed side elements and opposed cross pieces defining said rectangular shape having a proximal end and a distal end, means for adjustably pivotally securing the proximal ends of said longitudinally extending side members to the opposed side elements, respectively of said rectangular head member at a point intermediate the cross pieces thereof, the location of such pivot means being spaced from the cross piece located at the proximal end of said head member, whereby the portions of the side elements between the pivot means and the cross piece joining such portions at the proximal end of the head member provide parallel levers projecting from said pivot outwardly above said U-shaped frame and having said cross piece at the proximal end of said side elements and being selectively operable by the patient to apply or release tension, flexible strap means carried by the distal foot portion for attachment to the body of the patient, and flexible strap means carried by the distal cross piece of said head member for attachment to another part of the body of the patient, whereby when the extremities of the section of the patient's body to be treated are respectively secured to the strap means at each end of the apparatus, and the patient applies a force by pulling downwardly on said cross piece at the proximal end of said head member to activate said levers about said pivot, the lever action about said pivots tends to move the foot portion to which one body portion extremity is attached relatively away from the cross piece to which the other body portion extremity is attached thereby subjecting the body portion intermediate said strap means to tension.

2. A patient operated traction apparatus as defined in claim 1 wherein the location at which the head member is pivotally secured to the side members, respectively, is adjustable, whereby the overall length of the apparatus can be adjusted to accommodate the patient or the portion of the patient's body to be placed under tension.

3. A patient operated traction apparatus as defined in claim 1 wherein each of the side members also includes a plurality of locations adjacent the proximal end thereof for selective location of said pivot pin.

4. A patient operated traction apparatus as defined in claim 1 wherein the head end also includes at its distal extremity a portion for engagement with a flat surface.

5. A patient operated traction apparatus as defined in claim 1 wherein the foot end also includes at its distal extremity a portion for engagement with a flat surface.

6. A patient operated traction apparatus as defined in claim 1 wherein the foot end includes a bar transversely mounted on said frame and substantially coplanar therewith and said bar has a padded sleeve to which flexible strap means are secured, said strap means be adapted to hold a portion of the patient's body during tensioning thereof.

7. A patient operated traction apparatus as defined in claim 6 wherein the flexible strap means consists of a pair of flexible straps for attachment at the ankles of the patient.

8. A patient operated traction apparatus as defined in claim 1 wherein flexible strap means are secured to the cross piece located at the distal end of said head member.

9. A patient operated traction apparatus as defined in claim 1 wherein the distal extremity of said U-shaped portion includes a roller for facilitating movement across a flat surface of said extremity relative to the distal extremity of the head portion.

10. A patient operated traction apparatus as defined in claim 1 wherein the distal extremity of said head member includes a roller mounted on an axis parallel to the distal cross piece for facilitating movement across a flat surface of said distal extremity of said head member relative to the distal extremity of said U-shaped portion.

11. A patient operated traction apparatus as defined in claim 1 wherein the longitudinally extending side members are segmented and the segments are joined by releasable coupling means coacting between confronting ends of said segments.

* * * * *